US006393734B1

(12) United States Patent
Ou

(10) Patent No.: US 6,393,734 B1
(45) Date of Patent: May 28, 2002

(54) ADJUSTABLE AND DISPOSABLE FOOT CARE ARTICLE

(76) Inventor: Chan-Chou Ou, 2F-1, 7, Alley 4, Lane 7, Yungli Road, Yungho City, Taipei Hsien (TW)

( * ) Notice: Subject to any disclaimer, the term of this patent is extended or adjusted under 35 U.S.C. 154(b) by 0 days.

(21) Appl. No.: 09/791,642

(22) Filed: Feb. 26, 2001

(51) Int. Cl.[7] ..... A43B 3/26; A43B 17/00
(52) U.S. Cl. ..... 36/97; 36/10; 36/94
(58) Field of Search ..... 36/10, 94, 97, 36/3 R, 9 R

(56) References Cited

U.S. PATENT DOCUMENTS 2,288,199 A * 6/1942 Levy ..... 36/10
3,762,075 A * 10/1973 Munschy ..... 36/112
4,136,468 A * 1/1979 Munschy ..... 36/97

* cited by examiner

*Primary Examiner*—Ted Kavanaugh

(74) *Attorney, Agent, or Firm*—Rosenberg, Klein & Lee

(57) ABSTRACT

An adjustable and disposable foot care article includes a toe cover and an elongated insole bonded together to form a toe pocket at a front section. The insole is a bonded and pliable composite laminate consisting of an upper layer, an absorbent middle layer and a bottom layer made of air and fluid permeable non-woven fabrics or materials. The bottom layer has two side flaps extended outwards from the insole. The side flaps have spaced longitudinal perforation lines and a plurality of spaced and transverse perforation lines formed at selected locations for trimming excess portion of the side flaps and the heel section of the insole for the article to fit different sizes of foot. The article may be worn snugly on foot without flapping or flopping by fastening the rear end of the side flaps around the heel through an integrated or separated fastener. The article gives the foot and toes and part of the instep protective cover without contacting the musty or microbes-infected shoe interior. It may serve as a substitute for sock or stocking, or be worn with stocking or sock in the shoe without exposed or spoiling aesthetic appearance. It improves foot hygiene and adds comfort to foot by providing additional cushion and moisture absorption capability.

20 Claims, 7 Drawing Sheets

ADJUSTABLE AND DISPOSABLE FOOT CARE ARTICLE

BACKGROUND OF THE INVENTION

1. Field of the Invention

This invention relates to a foot care article and particularly a footwear that offers human foot a protective insole and cover for improving foot hygiene, providing additional cushion and perspiration absorption capability and is adjustable to fit different sizes of foot and disposable after a brief period of use.

2. Description of the Prior Art

The generally known footwear and foot care articles mostly have their merits and flaws. It usually takes more than one footwear or foot care article to complement one another to give human foot best possible protection and comfort. The prior art is replete with suggestions to attain this end. However foot care requirements vary widely among different people engaging in different activities in different seasons. The quest for improvement is a continuous issue.

Shoes and boots made of natural or synthetic leather can protect foot from injury, and keep foot dry, warm and free from soiled by outside environments. However they generally have relatively hard insole and poor cushion which could result in inner inflicted injury such as corns, blisters or chafing of foot skin. The leather shoes are not washable, thus create a lot of hygienic problems. The closed toe compartment tends to become damp and musty after trapping and accumulating foot perspiration and secretion for a period of time. It often becomes a breeding ground for microbes and fungus, and could result in foot disease as athlete's foot and generate foul odor. Shoes made of canvas and rubber such as sport shoes or sneakers generally have sponge-like insoles with relatively good cushion to absorb impact and pounding received by foot. However the insoles also absorb and accumulate a great amount of sweat and foot secretion. They are washable but difficult to dry. If not being washed and dried frequently, they tend to generate offensive foul smell. Some recent research indicated that foul smell of shoes and sneakers is mainly caused by bacteria. Hence it is not only a concern of physical feeling or comfort, but also a sanitary and health issue. Some people have resort to spraying germicide into the shoes and sneakers to attack this. problem. It is a messy and pollution producing way, and is not suitable for instant or outdoors use.

Hosiery products such as sock, stocking, pantyhose and the like may remedy some of the problems inherent to shoes and boots. They generally may smooth the rough interior of the shoes and boots and provide more comfort feeling to the foot. Thicker socks may offer a protective shield between foot and the musty shoe interior to offer some degree of sanitary function. But they also have their share of problems. Socks made from cotton, wool or other hydrophilic fibers have relatively good perspiration absorbing capability. However once damp, they become sticky and soiled easily when contact the sweat-stained interior of the shoes. Moreover visible socks often do not have aesthetic appealing to women wearing street shoes and dressed in skirts. Stocking and pantyhose made from nylon or manmade fibers generally have good stretch ability and aesthetic appealing to a lot of women. However they mostly do not have good moisture absorbing capability and could become tacky and not comfortable when wearing in warm seasons. They usually are knitted in a thin fabric and do not have much sanitary effect to fend off microbes or fungus that might breed in the shoes.

Hence there is always some trade off between aesthetic consideration and hygiene or comfort. Moreover cotton or wool socks are difficult to dry after washed, and stockings made from chemical fibers generally are not suitable for machine washing or drying. This could become an annoyance, especially during travel, trip or vacation when drying facilities and time are constrained. While disposable underwear is widely available on the market for use in such occasions, disposable sock or stocking is still not widely supplied or available in the marketplace.

There are various types of shoe insert or insole being proposed or introduced to remedy the deficiency of shoes and socks and stockings. They usually being made to provide some specific function, such as offering additional cushion, sweat-absorbing, deodorizing, microbes retarding or the like. They also have drawbacks. For instance, the inserts for adding more cushion and perspiration-absorption power usually need a greater thickness, and they will squeeze the foot too tight in the shoe and make the foot not comfortable (such as U.S. Pat. No. 5,216,825 to Brum). These shoe inserts are generally designed for durable use for a prolonged period of time. They also trap and accumulate sweat and foot secretion, hence their sanitary effect such as microbe retarding and odor adsorbing diminish rapidly with the time of use. The thinner inserts or disposable insoles tend to crumple under the friction of sock or sole when wearer puts on shoes. The inserts also need trimming to fit different sizes of shoe and are awkward to use. Most shoe inserts can only contact the sole and heel of wearer's foot and do not cover the instep and upper toe section. Their sanitary effect is limited. Because of these drawbacks, they have only limited market acceptance. References can be found in U.S. Pat. No. 4,151,660 (to Yoshimi et al), U.S. Pat. No. 4,864,740 (to Oakley), and U.S. Pat. No. 5,935,671 (to Lhuillier).

There are some other foot care or footwear articles designed to meet special purpose. For instance, U.S. Pat. No. 3,299,894 (to Charlebols) and U.S. Pat. No. 3,882,868 (to Tundermann) offer foot appliance and toe cover shaped like a truncated slipper impregnated with medicated foot-care agents mainly for medical purpose. U.S. Pat. No. 5,404,657 (to Honeycutt) discloses a shoe protector that is mainly to protect new shoes from soils when trying-on at shoe stores rather than to protect the foot. U.S. Pat. No. 4,021,941 (to Caggiano) offers a disposal footwear which has limited adjustment capability to fit different sizes of foot. U.S. Pat. No. 3,762,075 (to Munschy), U.S. Pat. No. 4,136,468 (to Munschy), U.S. Pat. No. 4,599,811 (to Rousseau), and U.S. Pat. No. 5,699,629 (to Munschy) disclose disposable or adjustable footwear for specific environments or occasions mainly as substitutes for ordinary shoes. They have either aesthetics, practicality or cost problem, and do not have wide acceptance on the market. Then there are special purpose hosiery articles such as those proposed in U.S. Pat. No. 5,575,013 (to Krack), U.S. Pat. No. 5,603,232 (to Throneburg), and U.S. Pat. No. 6,016,575 (to Prychak). They mostly try to provide additional moisture retention or cushion function, but have limited adjustment capability to suit different sizes of foot and are generally not for disposable use. There are also disposable or adjustable slippers or scuff. Reference can be found in U.S. Pat. No. 4,571,851 (to Yamada) and U.S. Pat. No. 5,265,349 (to Munschy). The slippers tend to flap and flop when worn and walk, hence only suitable for use in limited occasions.

Although the foregoing references have provided abundant choices, there are still a lot of footwear and foot care needs not being totally fulfilled or satisfied as yet. For instance, in the occasions of trip, or travel or vacation, where facilities or time for washing and drying socks or stockings are limited; women who wear low cut shoes in warm seasons but do not want to wear tacky stockings or aesthetic-spoiling socks; people who tend to have profusion of foot perspiration or engage in vigorous physical activities such as sports, exercise, hiking, or the like and do not want the feet soaked in the soggy socks all the time, or do not want to carry the wetted socks after replacement; or people who want feet healthy and in good sanitary condition without soiled by the musty and bacteria contaminated shoes or sneakers. None of known prior art or presently available footgear can fully meet all these requirements in a convenient way at a reasonable price. There are still rooms for improvement.

SUMMARY OF THE INVENTION

It is therefore an object of this invention to provide a protective insole and cover to shield the foot, especial the. toes and sole, from direct contacting the perspiration-tainted or microbes-infected shoe interior for keeping the foot in a sanitary and healthy condition.

Another object of this invention is to provide a disposable footwear for use with shoes or hosiery products that offers additional cushion and moisture absorption capability to absorb impact received by foot and remove excess sweat from the foot or hosiery articles for protecting the foot from injury and adding comfort to the foot.

A further object of this invention is to provide a footwear that has a toe cover, insole and side flaps to give foot sufficient protective coverage and may be worn in shoe without exposed for adding wearer's comfort without spoiling aesthetic appearance.

Yet another object of this invention is to provide an adjustable footwear that may be flexibly changed to fit different sizes of foot, and is adaptable for men and women,. left foot and right foot so that it can be made at a low cost for disposable use.

Still another object of this invention is to provide a disposable footwear that is convenient to use and may be packed in a small size for users to carry handily so that users may replace the damp footwear easily to keep the foot at a dry and comfortable condition constantly.

Another object of this invention is to provide a footwear that includes an insole and a toe pocket which has five separated toe pouches to encase the toes for improving air ventilation between the toes, and allaying discomfort resulting from excess perspiration and irritation on the toes crowding in the closed toe compartment of the shoe.

Still another object of this invention is to provide a disposable foot care article that contains selected medical agents for curing microbe infected foot diseases or guarding the foot and toes from microbe and fungus contagion.

The adjustable and disposable foot care article according to this invention includes a toe cover bonded to an insole to form a toe packet at the front section. The toe pocket has a curved and closed front rim and a rear opening. The insole is a pliable composite laminate including an upper layer, an absorbent layer in the middle and a bottom layer. The insole is an elongated member which has a relatively wide front and middle section and a narrower heel section, and is substantially symmetrical transverse wise. The bottom layer has two side flaps extended transversely outward from two lateral sides of the middle and heel section of the insole. The side flaps have two longitudinal heel perforation lines formed adjacent the side edges of the heel section and a plurality of transverse and spaced perforation lines running across the heel section, and one or more spaced longitudinal flap perforation lines formed thereon.

The foot care article of this invention may be adjusted to fit different sizes of foot by trimming excess heel section from the rear end and excess side flaps from the outer edges along selected perforation lines. The rear end of the side flaps may be wrapped around the heel and fastened together by a fastener so that the article may be worn snugly on the foot without flapping or flopping. The foot care article can fully cover the sole and toes, and partly cover the instep up to the upper rim of the shoe. It gives foot protection and comfort desired and may be worn without exposed outside the shoe.

This foot care article is adaptable to men and women, right foot and left foot, and may be made to fit a wide range of foot sizes so that it can be made at a low cost for disposable use. The foot care article may serve as a substitute for sock or stocking. It is especially useful and convenient in the occasions of travel, vacation, or trip where washing and drying facilities or time are limited. It also may be worn with stocking or pantyhose for improving foot hygiene, adding cushion and moisture absorption capability without spoiling aesthetic appearance. It also may be worn with sock for adding cushion and foot sweat absorption power, especially for people who perspire heavily or engage in vigorous physical activities such as sports, exercise, hiking, or the like. The damp or soiled foot care article may be discarded and replaced easily so that the foot may be kept at a dry, hygienic and comfortable condition constantly.

In another aspect, the foot care article of this invention may serve medical purpose by impregnating with medical agents such as antibacterial, fungicidal or deodorizing ingredients for healing or retarding foot diseases such as athlete's foot.

The foot care article of this invention may be packed in a small size and be carried handily in a clothes pocket or handbag, and may be worn or changed easily at any location desired such as rest rooms, or be sold conveniently through vending machines.

The invention, as well as its many advantages, may be further understood by the following detailed description and drawings. The drawings are only to serve for reference and illustrative purpose, and do not intend to limit the scope of the present invention.

DETAILED DESCRIPTION OF THE PREFERRED EMBODIMENTS

Figure 1:
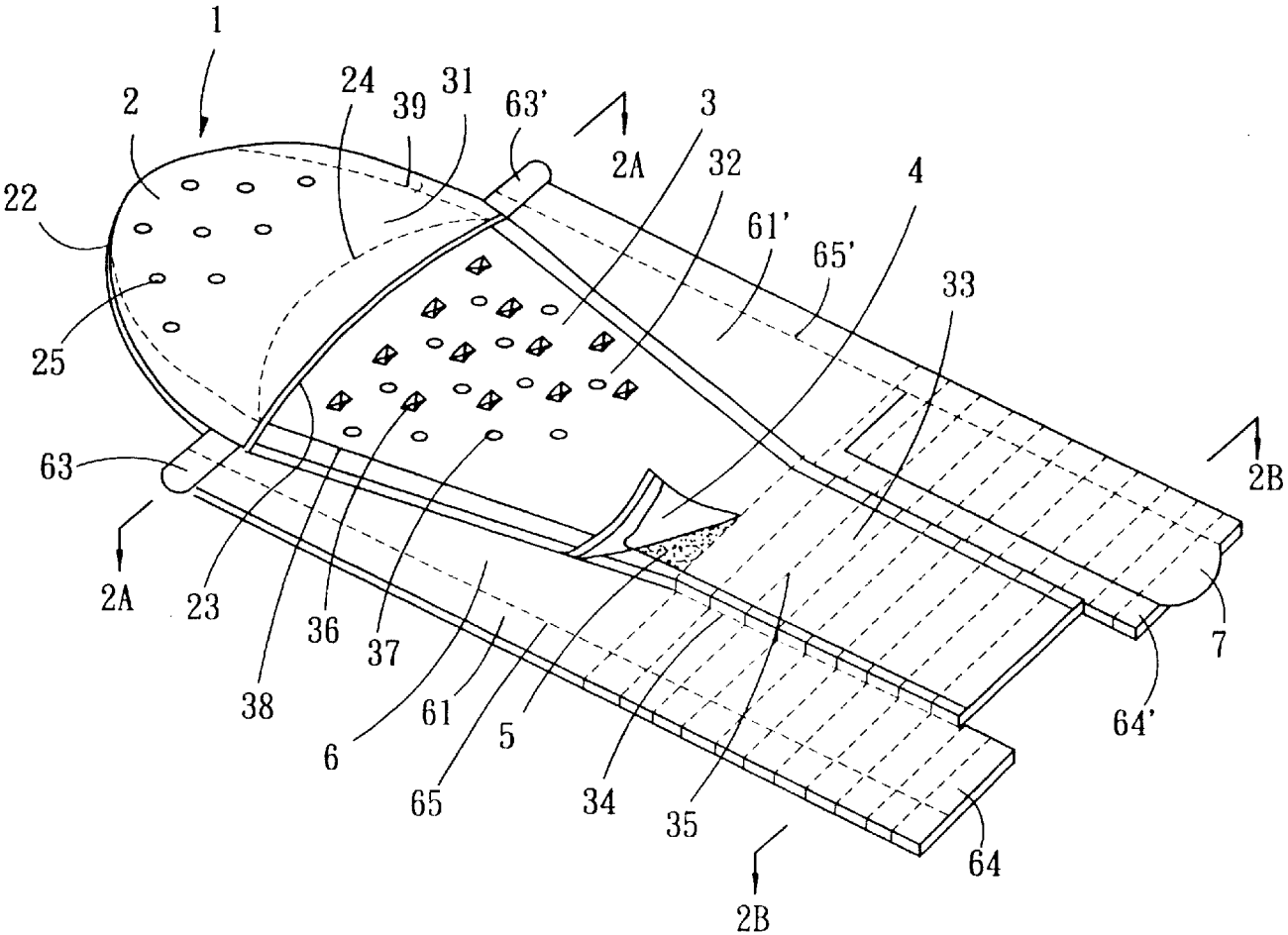
FIG. 1 is a perspective view of an embodiment of this invention.
Figure 2A:
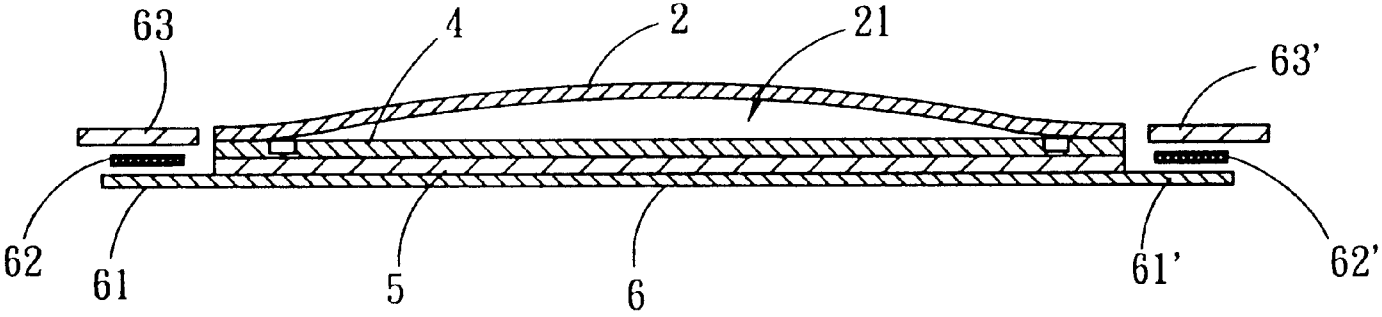
FIG. 2A is a cross sectional view of this invention, taken on line 2A—2A in FIG. 1.
Figure 2B:
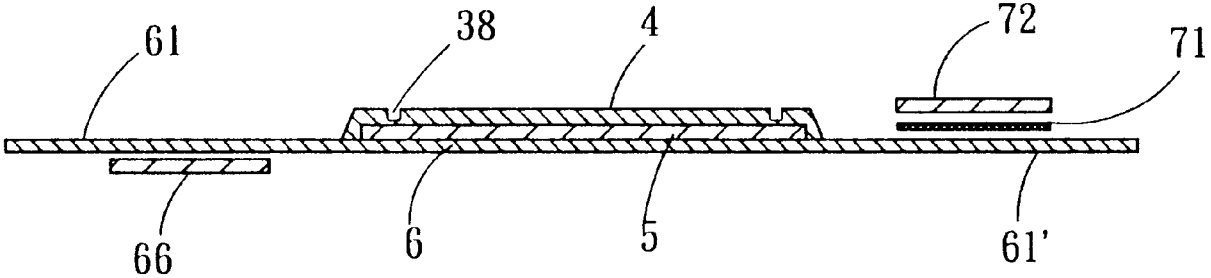
FIG. 2B is a cross sectional view of this invention, taken on line 2B—2B in FIG. 1.

Referring to FIGS. 1, 2A and 2B for an embodiment of this invention, the foot care article, generally designated 1, includes a toe cover 2 and an insole 3. The toe cover 2 is bonded to the insole 3 at the peripheral rim to form a toe pocket 21 which has a closed and curved front end 22, a rear edge 23 and an opening below the rear edge 23 for the toes and front portion of the foot to slip into the toe pocket 21 when in use.

The insole 3 is a pliable composite laminate consisting of at least one layer. The insole 3 according toone embodiment of this invention includes an upper layer 4, an absorbent layer 5 located in the middle and a bottom layer 6. The insole 3 is an elongated member and is generally shaped to support the sole and heel of human foot, and includes a front section 31 located beneath the toe cover 2, a middle section 32 extended rearward from the front section 31 and a heel section 33 at the rear end of the insole 3. The insole 3 has a relatively greater transverse width at the front and middle section 31 and 32, and a narrower width at the heel section 33. The insole 3 is substantially symmetrical transverse wise so that it may accommodate the left foot or right foot equally well.

The bottom layer 6 extends outwards from the middle section 32 and heel section 33 to form a first side flap 61 and a second side flap 61' at two lateral sides thereof The side flaps 61 and 61' have respectively a longitudinal heel perforation line 34 formed adjacent the lateral side of the heel section 33. The heel section 33 has a plurality of spaced transverse perforation lines 35 formed thereon. The front ends of the side flaps 61 and 61' are extended longitudinally beyond the rear edge 23 and overlap with the toe cover 2 for a selected length, and have respectively coated with a side adhesive patch 62 and 62' at the upper surface thereof. The side adhesive patches 62 and 62' are covered respectively by a side release strip 63 and 63'. The rear ends of the side flaps 61 and 61' are extended rearwards beyond the rear end of the heel section 33 to respectively form a flap rear end 64 and 64'. On the side flaps 61 and 61', there are at least one longitudinal flap perforation line 65 and 65' formed respectively thereon with a selected interval therebetween and spaced from the side edge thereof. On the upper surface of the second side flap 61', there is a heel fastener 7 disposed thereon and extended to the flap rear end 64'. The transverse perforation lines 35 also are extended in both directions and across the side flaps 61 and 61' and the fastener 7. The toe cover 2 may also have one or more arched toe cover perforation line 24 formed thereon with a starting and an. ending point adjacent the rear edge 23. The longitudinal length of the insole 3 from the front end 22 of the toe cover 2 to the rear end of the heel section 33, and the transverse width of the insole 3 are preferably great enough to accommodate a wide range of foot sizes.

The toe cover 2, upper layer 4 and bottom layer 6 are preferably made of air and fluid permeable non-woven fabrics now commercially available such as those used widely in diaper and sanitary articles. The absorbent layer 5 is preferably made from materials that have high moisture absorption and retention capability such as a blend of wood pulp fibers, absorbent polymer fibers, cellulose fluff, and the like that are also known in the art. The upper layer 4 and absorbent layer 5 are bonded to the bottom layer 6 at thee periphery edges of the upper layer 4 to form the insole 3 by heat fusion, sonic sealing, hot melt adhesive or other adhering methods known in the art. Similar bonding methods may be employed to bond the toe cover 2 to the insole 3.

Figure 3:
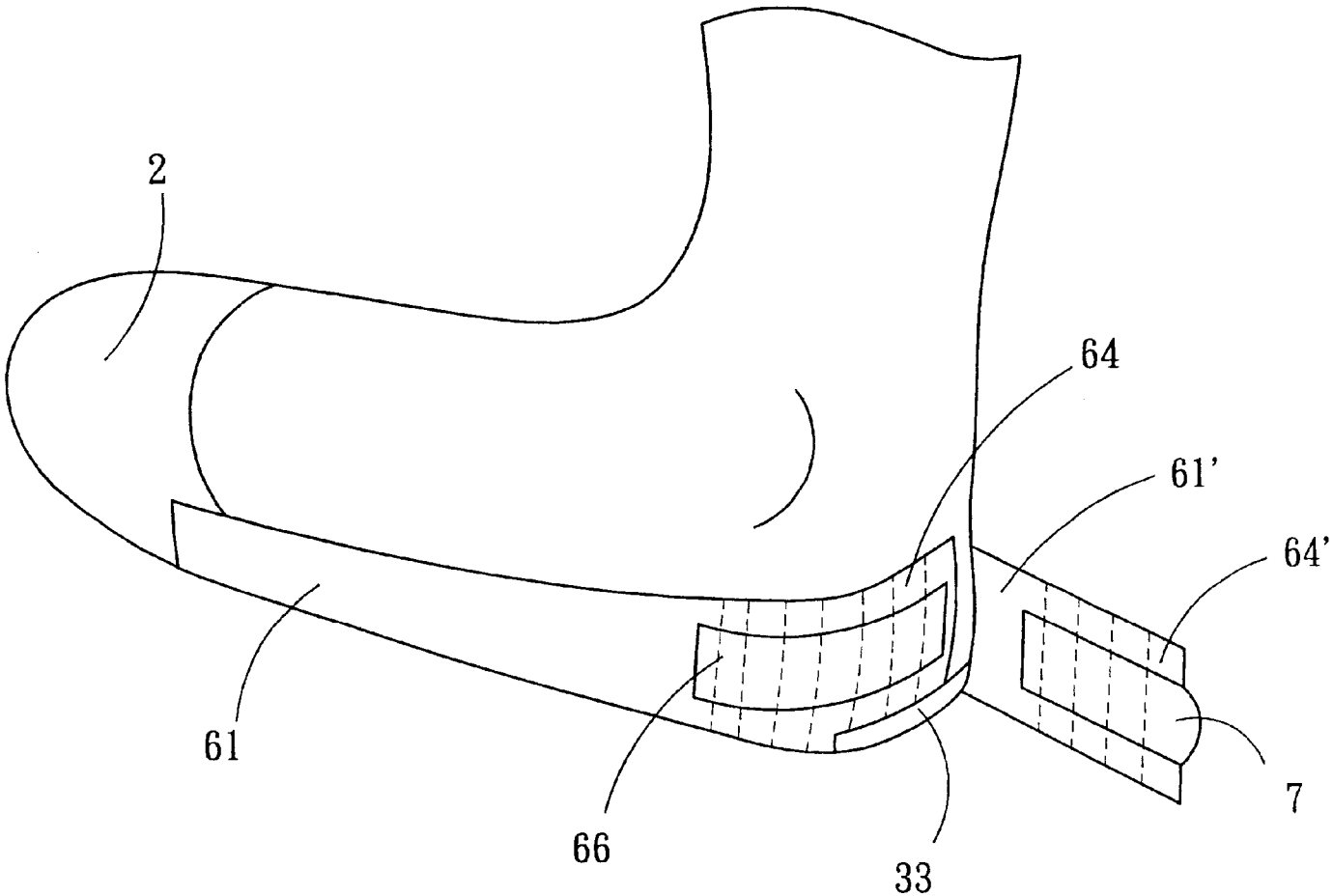
FIG. 3 is a pictorial view of this invention in use.
Figure 4:
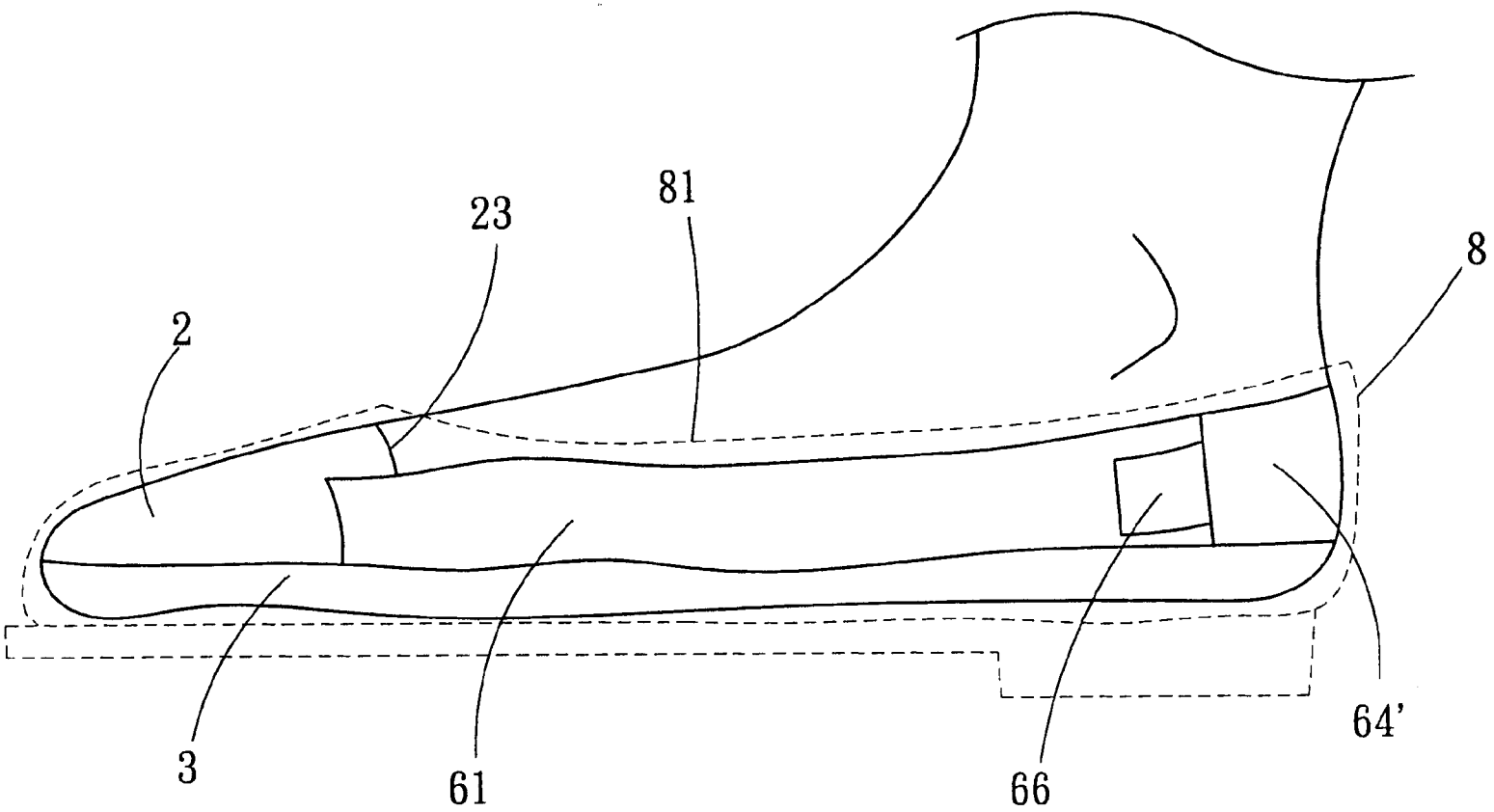
FIG. 4 is a side view of this invention in use.

Referring to FIGS. 3 and 4, when in use, wearer puts the toes and front foot portion into the toe pocket 21, and visually measures and identifies the transverse perforation line 35 matching the rear side of the heel of the foot; then tears the longitudinal heel perforation lines 34 from the rear end of the heel section 33 until reaching the heel, and trims excess portion of the heel section 33 along the identified transverse perforation line 35 such that the remaining insole 3 will have sufficient length to fully accommodate the sole and heel of the foot. Similarly, the wearer may choose to reserve a portion of the flap rear end 64 to wrap around the heel and trims the excess flap rear end 64 along one transverse perforation line 35, then wraps another flap rear end 64' around the heel and uses the heel fastener 7 to fasten to the outer surface of the first side flap 61. Similarly, excess outer margin of the side flaps 61 and 61' may be trimmed along selected flap perforation lines 65 and 65', and part of the rear portion of the toe cover 2 may also be removed by trimming along a selected toe cover perforation line 24 such that the foot care article 1 may be worn in the shoe 8 without exposed outside the upper rim 81 or vamp of the shoe if so desired (shown by broken lines in FIG. 4). All the trimming and adjusting may be done by hands without using any tool. The side release strips 63 and 63' may be peeled off for the side adhesive patches 62 and 62' adhering to the toe cover 2 so that the side flaps 61 and 61' may cover the lateral sides of the foot securely, and also to stretch and smooth the toe cover 2 without forming creases over the instep of the foot.

The foot care article 1 thus worn on the foot has the insole 3 completely covering the sole of the foot, the toe pocket 21 covering the toes and front portion of the instep, and the side flaps 61 and 61' covering the two lateral sides of the foot. As a result, the foot does not directly contact the shoe interior, especially the closed toe compartment which is most likely become musty or microbe-infected by accumulation of perspiration or secretion emanated from the foot. Moisture or foot perspiration will be siphoned away from the sole and toes to the absorbent layer 5 for retention, and from the toes and instep to the toe cover 2 and side flaps 61 and 61' for dispersing and vaporizing. The foot care article 1 may be worn snugly on foot without flapping or flopping like wearing slippers. It can be used as a substitute for sock or stocking, or be worn with sock or stocking for adding cushion and moisture absorption capability.

The foot care article 1 of this invention may also allay the chafing of foot skin at the ankle area, especially when wearing new shoes at the initial fitting period. For use in such an occasion, instead of trimming, the excess heel section 33 may be pulled upward behind the heel to cover the ankle (not shown in the drawings), then wrap the flap rear ends 64 and 64' behind the heel section 33 and fasten the flap rear ends 64 and 64' in an overlap manner. As this article may be worn inside the stocking or socks, it may be worn invisibly from outside without compromising the aesthetic appearance.

The foot care article 1 may be made from different combination of materials for users to get the best possible protection and comfort in different occasions. For instance, when to use this article as a substitute for sock or stocking to direct contact the skin, or to wear the article inside the stocking made of chemical fibers such as nylon (which are generally hydrophobic), the toe cover 2 and bottom layer 6 are preferable made of hydrophilic fabric for absorbing sweat from the toes and instep to facilitate moisture vaporization at the upper an lateral sides of foot and shoes, while the upper layer 4 contacting the sole is preferably made of hydrophobic fabric for siphoning moisture away from the sole and toes to the absorbent layer 5 to keep the sole and toes at the bottom side relatively dry without become tacky. When to wear the foot care article 1 outside the stocking, the toe cover 2, upper layer 4 and bottom layer 6 are preferably made of hydrophilic fabric to siphon moisture away from the foot and stocking so that the sole and instep will become relatively dry without become tacky. This article may be worn with sock made of hydrophilic fibers, either inside or outside the sock, for adding cushion and moisture absorption power as long as the fabrics and material being used for the toe cover 2 and insole 3 are air and fluid permeable.

The construction of the foot care article 1 set forth above has a number of advantages. This article is very versatile and may be flexibly adjusted to fit a wide range of foot sizes for men and women, and left foot and right foot. This will help to reduce cost and enables it become disposable economically. As the toes and sole and part of the instep are covered and without contacting the sweat-tainted or musty shoe interior, the foot may be kept at a sanitary and healthy condition and is less likely be to infected by fungus or microbes. The absorbent layer adds more cushion to absorb impact force and more moisture absorption capability to keep foot drier and more comfortable, and may reduce foot injury such as avoiding forming corns. This article may be worn inside the shoe, or with sock or stocking without exposed, hence it fits well and easily with any type of clothing outfits without spoiling aesthetic appearance. It is also helpful for people who tend to have profusion of foot perspiration or engage in vigorous physical activities such as sports, exercise, hiking, or the like. The damp or soiled foot care article may be taken off and discarded for replacing a dry one easily so that wearer's feet do not have to soak in the wetted socks all the time, and the wearer also is free from the trouble of carrying the soggy and soiled socks being replaced. It is especially convenient in the occasions of trip, vacation or travel where washing and drying facilities or time are constrained, or when people on the road simply do not want the trouble of washing and drying the socks or stockings in such occasions.

The foregoing description illustrates the basic construction, features, function and advantages of this invention. Various embodiment alterations may be made to further advance its usefulness and benefits. The following depicts some of the possible embodiments.

For instance, in order to prevent the foot from slipping in the foot care article 1 or the foot care article 1 from slipping in the shoe or sock or stocking, the upper layer 4 and bottom layer 6 may be embossed with selected patterns 36 to form an abrasive surface texture (as shown in FIG. 1). The toe cover 2 and insole 3 may also be formed respectively with a plurality of apertures 25 and 37 to facilitate air ventilation (also shown in FIG. 1). When people walk with the foot care article 1 on the foot, a pumping effect will take place between the shoe and foot to suck in and expel air alternately through the apertures 25 and 37 to accelerate air ventilation and moisture vaporization.

As the foot article 1 is designed to fit a wide range of foot sizes, the toe cover 2 and insole 3 are initially set to accommodate foot of a relatively large size. When to accommodate the foot of smaller sizes, the longitudinal length may be adjusted by trimming excess heel section 33 through the transverse perforation lines 35 as set forth before. The width difference of most people's foot is relatively smaller than the length difference, hence to adjust the insole 3 transversely to fit a smaller foot, the excess transverse margin may be wrapped upward to cover the lower lateral sides of the foot (as shown in FIG. 4). FIGS. 1 and 2B also show another embodiment alternative in which one or more longitudinal pressed bend line 38 is formed on the insole 3 and spaced from each lateral edge of the insole 3 so that wrapping up of the excess transverse margin of the insole 3 will be easier thereby to fit, the foot more snugly. Similarly, the front section 31 of the insole under the toe pocket 21 also may have one or more press bend line 39 formed in an arched form or a slant angle for the front section 31 to wrap around the toes snugly to fit the smaller foot. By means of such construction, the foot care-article 1 may be made one size to accommodate a wide range of foot sizes inexpensively. Of course, it may also be made in different sizes such as small, medium and large so that each size of foot care article 1 may fit a limited range of foot sizes even more snugly.

Figure 5B:
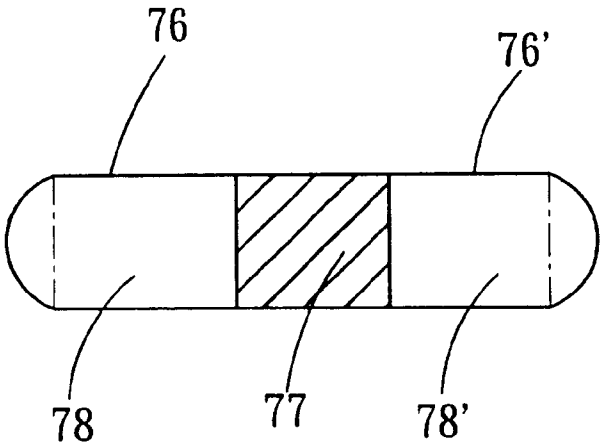
FIG. 5B is a top view of another embodiment of a fastener of this invention.
Figure 5A:
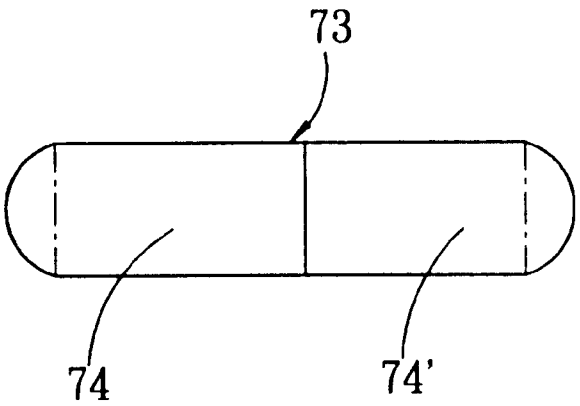
FIG. 5A is a top view of an embodiment of a fastener of this invention.

The fastener 7 may be selected from various types of fasteners known in the art FIGS. 1, 2A and 2B show one which is coating a heel adhesive patch 71 on the upper surface of the second side flap 61' and covered by a heel release strip 72. When in use, wrap the first flap rear end 64 around the heel, and peel off the heel release strip 72 for a length desired and adhere the heel adhesive patch 71 to the outer surface of the first side flap 61 (shown in FIG. 3). In order to add adhering force or to enable the heel adhesive patch 71 be repeatedly used for adjusting the foot care article 1 as desired, a strip of cellulose paper 66 may be provided at the outer surface of the first side flap 61 for the adhesive patch 71 to adhere to thereon (shown in FIG. 4). Another fastener embodiment is to prepare a separate adhesive tape 73 (shown FIG. 5A) which is covered about equally halves by two release strips 74 and 74'. When in use, peel one of the release strips (74', for instance) to expose a half of the adhesive tape 73 for adhering to the flap rear end 64' at the outer side, then wrap the flap rear end 64' around the heel and peel off another release strip 74 to adhere the exposed adhesive tape 73 to the outer side of the first side flap 61 (not shown in the drawings). The side flaps 61 and 61' also may be disposed respectively with a strip of cellulose paper 66 to add adhesion force and for repetitive adjustment use. Similarly, the integrally formed side adhesive patches 62 and 62', and side release strips 63 and 63' may also be replaced by separated adhesive tapes 73 to make the fabrication process of the foot care article 1 simpler. FIG. 5B shows another embodiment of the fastener which has an elastic element 77 (such as rubber band) interposed between two adhesive tapes 76 and 76'. The adhesive tapes 76 and 76' are also covered respectively by release strips 78 and 78'. It is used as the one shown in FIG. 5A, however because of the elastic element 77, the flap rear ends 64 and 64' may be wrapped on the heel more securely without slipping off when wearer walks with the foot care article 1 before putting on shoes.

Figure 6:
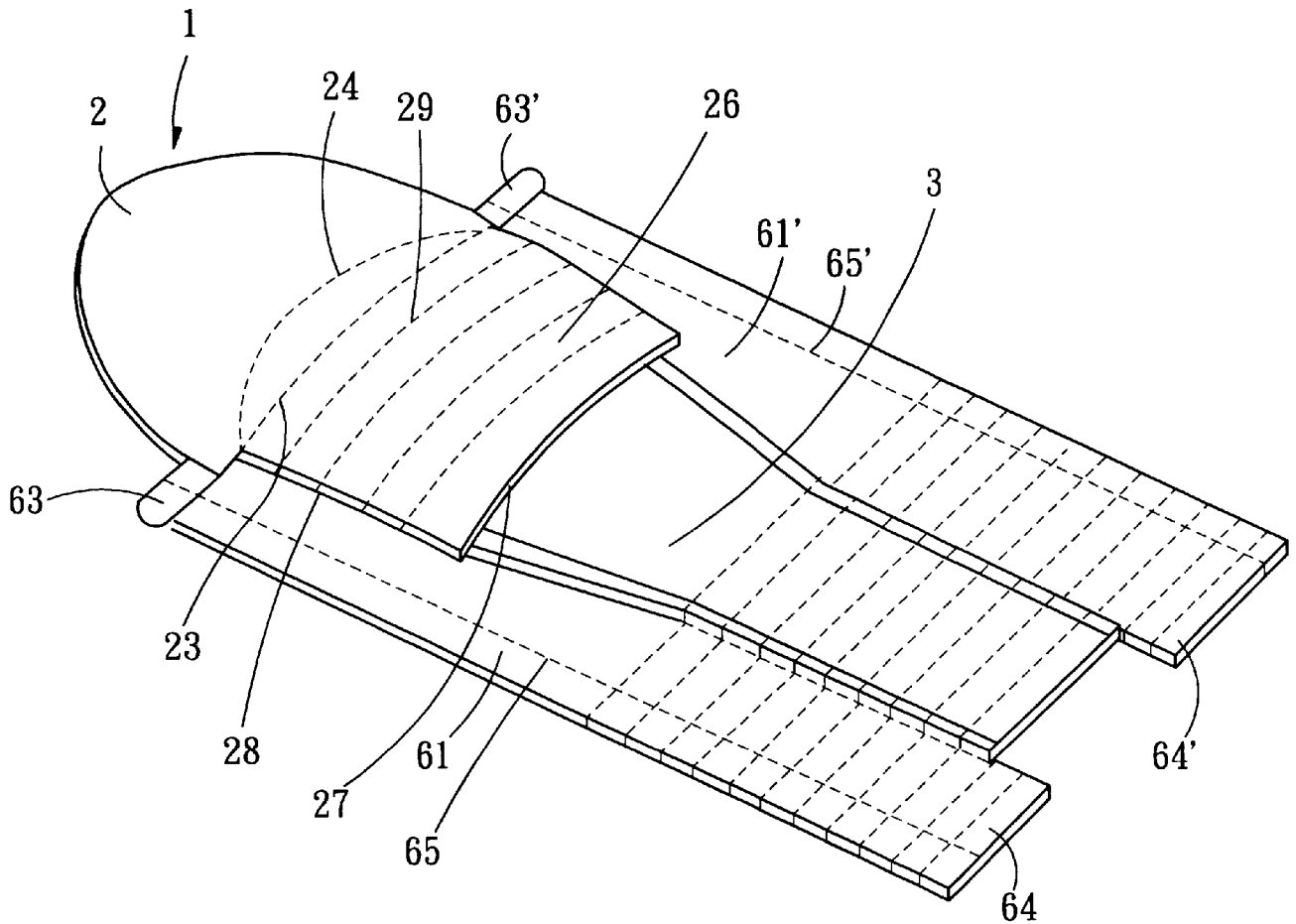
FIG. 6 is a perspective view of another embodiment of this invention.

FIG. 6 illustrates another embodiment adapted for boots, or shoes with vamp or tongue, or more coverage of the instep portion is desired. The toe cover 2 has a tongue flap 26 extended rearwards from the rear edge 23 of the toe pocket 21 for a selected length. The tongue flap 26 has a rear tongue edge 27 and two side edges 28 and a plurality of spaced transverse tongue perforation lines 29 formed thereon. With the aids of the side flaps 61 and 61', the foot care article 1 thus formed may give the instep more coverage desired. To fit for foot of smaller size, the excess tongue flap 26 and side flaps 61 and 61' may be trimmed along a selected tongue perforation line 29 and flap perforation lines 65 and 65'. The tongue flap 26 may also attach to the side flaps 61 and 61' by means of the adhesive tape 73 (referring to FIG. 5A) for covering the instep securely.

Figure 7:
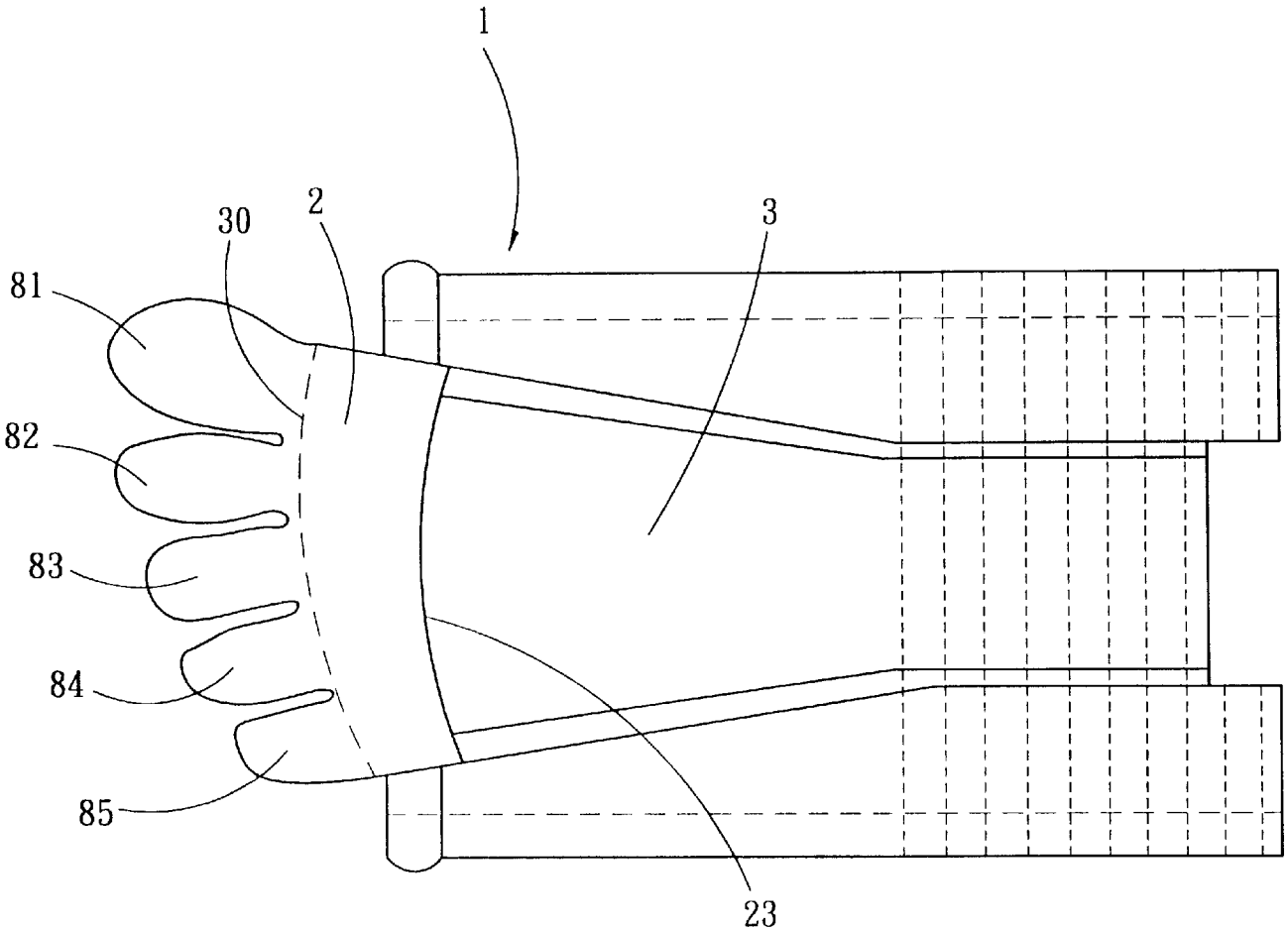
FIG. 7 is a top view of a further embodiment of this invention.

FIG. 7 shows yet another embodiment of this invention adapted to help reducing discomfort from excess perspiration or preventing microbe or fungus infection at the toes. The front section of the toe pocket 21 forms five separated toe pouches 81 82, 83, 84 and 85 which have various sizes for accommodating different sizes of toes separately. This can improve air ventilation between the toes and soothe burning and irritation for the toes crowded in the sweltering toe compartment of shoes or boots, particularly in warm seasons. In order to make the toe pouches more supple to fit the toes more snugly and comfortably, the upper layer 4 and absorbent layer 5 at the front section 31 may be ended at a front edge 30 outside the toe pouches, and the toe pouches are formed by bonding only the toe cover 2 and bottom layer 6. The toe cover 2 and insole 3 (including the toe pouches) may also be impregnated with desired foot care medical agents such as anti-microbial, fungicidal, or deodorant agents for curing foot diseases or retarding bacteria or fungus infection. In this embodiment the foot care article 1 for right foot and left foot will be made separately.

In order to give the foot best possible fit and comfort, the toe cover 2, and upper layer 4 and bottom layer 6 are preferably made of air and fluid permeable non-woven fabrics, and the fabrics with some degree of stretchable capability are even more desirable. One of such fabrics is indicated in U.S. Pat. No. 5,422,172 (to Pai-Chuan Wu). The toe cover 2, including the toe pouches shown in FIG. 7, and the insole 3 may be formed by die-cutting from a blank web and be flatly bonded together. The toe cover 2 and front section 31 preferably have a greater transverse width and margin to accommodate the bulged toe and front end of the foot when worn. Another alternative is to use a general foot mold (including the toe pouches, in case for the embodiment shown in FIG. 7) to form a bulged toe pocket 21 (not shown in the drawings), then the toe cover 2 and front insole section 31 may have a narrower transverse width and margin to accommodate different foot sizes. The foot care article 1 of this invention may be adapted for mass production easily at a low cost to become a disposable item at an affordable price. It also may be packaged to a small size to facilitate carrying or sales through vending machines and convenient stores.

While particular embodiments of the present invention have been illustrated and described for purpose of disclosure, it would be obvious to those skilled in the art that various other changes and modifications can be made without departing from the spirit and scope of the invention.

What is claimed is:

1. An adjustable and disposable foot care article for protecting a human foot from direct contacting the interior of shoe, comprising:

a toe cover for covering a front portion of the human foot;

an insole for supporting the sole and heel of the foot, including:

an upper layer located below the toe cover and extended rearward therefrom for a selected length;

an absorbent layer located beneath the upper layer being substantially formed in the shape of the upper layer and including means for absorbing and retaining moisture; and a bottom layer located beneath the absorbent layer; and a fastening means;

wherein the upper and absorbent layer are bonded to the bottom layer at the periphery of the upper layer to form a composite laminate which has a front section located below the toe cover, a middle section extended rearwards from the front section and a heel section extended from the middle section for a selected length, the toe cover being bonded to the front section to form a toe pocket which has a closed and curved front rim and a rear edge and an opening below the rear edge, the bottom layer having two side flaps extended outwards from two lateral sides of the middle and heel section, the side flaps having two longitudinal heel perforation lines formed adjacent the lateral sides of the heel section, and a plurality of spaced and transverse perforation lines formed thereon running across the heel section, the fastening means having one end attached to one side flap and another end engageable with another side flap around the heel.

2. The adjustable and disposable foot care article of claim 1, wherein the toe cover, upper layer and bottom layer are made of air and fluid permeable non-woven fabrics.

3. The adjustable and disposable foot care article of claim 1, wherein the insole has at least two pressed bend lines spaced respectively from two lateral sides of the insole for a selected distance.

4. The adjustable and disposable foot care article of claim 1, wherein the side flaps have respectively a front end overlapped with the toe pocket from the rear edge for a selected length, the front end having a side fastener located thereon for attaching to the toe cover.

5. The adjustable and disposable foot care article of claim 4, wherein the side fastener includes a side adhesive patch disposed on an upper surface of the front end and a side release strip covering the side adhesive patch.

6. The adjustable and disposable foot care article of claim 1, wherein the fastening means includes a heel adhesive patch disposed on an upper surface of one side flap and a heel release strip covering the heel adhesive patch.

7. The adjustable and disposable foot care article of claim 6, wherein the bottom surface of another side flap has a strip of cellulose paper attached thereon for engaging with the heel adhesive patch.

8. The adjustable and disposable foot care article of claim 1, wherein the fastening means includes an adhesive tape which is covered by two release strips at two ends thereof.

9. The adjustable and disposable foot care article of claim 1, wherein the fastening means includes two separated adhesive tapes engaged with an elastic element located therebetween, each adhesive tape being covered by a release strip.

10. The adjustable and disposable and adjustable foot care article of claim 9, wherein the bottom surface of the side flaps have respectively a strip of cellulose paper attached thereon for engaging with the adhesive tape.

11. The adjustable and disposable foot care article of claim 1, wherein each side flap has at least one longitudinal flap perforation line formed thereon which is spaced for a selected distance from the outer edge thereof, and the toe cover has at least one arched toe cover perforation line formed thereon starting from the rear edge.

12. The adjustable and disposable foot care article of claim 1, wherein the toe cover and insole have respectively a plurality of apertures formed therein.

13. The adjustable and disposable foot care article of claim 1, wherein the upper layer and bottom layer have respectively embossed patterns to form an abrasive surface texture thereon.

14. The adjustable and disposable foot care article of claim 1, wherein the toe cover further has a tongue section extended rearwards from the rear edge for a selected length, the tongue section having a plurality of spaced and transverse tongue perforation lines formed thereon.

15. The adjustable and disposable foot care article of claim 1, wherein the toe cover and insole are impregnated with selected anti-microbial and deodorant agents.

16. The adjustable and disposable foot care article of claim 1, wherein the toe pocket has five separated toe pouches of selected sizes formed at a front section thereof, the toe pouches having respectively a closed front rim and a rear opening for accommodating the toes of the foot.

17. The adjustable and disposable foot care article of claim 16, wherein the toe pouches are formed by bonding the toe cover to the bottom layer without the upper layer and absorbent layer.

18. The adjustable and disposable foot care article of claim 17, wherein the side flaps have respectively a front end overlapped with the toe pocket from the rear edge for a selected length, the front end having a side fastener located thereon for attaching to the toe cover.

19. The adjustable and disposable foot care article of claim 17, wherein each side flap has at least one longitudinal flap perforation line formed thereon which is spaced for a selected distance from the outer edge thereof, and the toe cover has at least one arched toe cover perforation line formed thereon starting from the rear edge.

20. The adjustable and disposable foot care article of claim 17, wherein the toe cover further has a tongue section extended rearwards from the rear edge for a selected length, the tongue section having a plurality of spaced and transverse tongue perforation lines formed thereon.

* * * * *